US006779971B2

(12) United States Patent
Garrett

(10) Patent No.: US 6,779,971 B2
(45) Date of Patent: Aug. 24, 2004

(54) TURBINE

(75) Inventor: Stephen E. Garrett, Huddersfield (GB)

(73) Assignee: Holset Engineering Company, Limited, Huddersfield (GB)

( * ) Notice: Subject to any disclaimer, the term of this patent is extended or adjusted under 35 U.S.C. 154(b) by 0 days.

(21) Appl. No.: 09/975,862

(22) Filed: Oct. 12, 2001

(65) Prior Publication Data

US 2002/0081194 A1 Jun. 27, 2002

(30) Foreign Application Priority Data

Oct. 12, 2000 (GB) ..... 0025244

(51) Int. Cl.[7] ..... F01D 17/16
(52) U.S. Cl. ..... 415/156; 415/159; 415/160
(58) Field of Search ..... 415/160, 156, 415/159

(56) References Cited

U.S. PATENT DOCUMENTS

| | | | | |
|---|---|---|---|---|
| 3,376,018 A | * | 4/1968 | Williamson | 415/160 |
| 3,566,916 A | * | 3/1971 | Root | 415/160 |
| 3,719,427 A | * | 3/1973 | Davis | 415/160 |
| 3,945,762 A | * | 3/1976 | Leicht | 417/18 |
| 4,054,398 A | * | 10/1977 | Penny | 415/156 |
| 4,378,960 A | | 4/1983 | Lenz | |
| 4,430,043 A | * | 2/1984 | Knight et al. | 415/159 |
| 4,452,564 A | | 6/1984 | Conant et al. | |
| 4,497,171 A | | 2/1985 | Corrigan et al. | |
| 4,643,640 A | | 2/1987 | Burdette et al. | |
| 4,652,208 A | | 3/1987 | Tameo | |
| 4,654,941 A | | 4/1987 | Burdette et al. | |
| 4,659,295 A | | 4/1987 | Burdette et al. | |
| 4,679,984 A | | 7/1987 | Swihart et al. | |
| 4,767,264 A | | 8/1988 | Kisling | |
| 4,781,528 A | | 11/1988 | Hagita et al. | |
| 4,799,856 A | | 1/1989 | Matsudaira et al. | |
| 4,979,874 A | | 12/1990 | Meyers | |
| 5,441,383 A | | 8/1995 | Dale et al. | |
| 5,494,404 A | | 2/1996 | Furseth et al. | |
| 5,547,342 A | | 8/1996 | Furseth et al. | |
| 5,947,681 A | | 9/1999 | Rochford | |

FOREIGN PATENT DOCUMENTS

| | | |
|---|---|---|
| DE | 19814894 | 10/1998 |
| EP | 0227475 | 7/1987 |
| GB | 1511723 | 5/1978 |
| GB | 2176251 | 5/1986 |
| GB | 2232725 | 12/1990 |
| GB | 2276423 | 9/1994 |
| JP | 7279680 | 10/1995 |
| JP | 8177509 | 7/1996 |
| JP | 9013980 | 1/1997 |
| JP | 9104259 | 4/1997 |
| JP | 9112511 | 5/1997 |
| JP | 9296731 | 11/1997 |
| JP | 10026028 | 1/1998 |
| JP | 10077912 | 3/1998 |
| JP | 10141076 | 5/1998 |
| JP | 10141077 | 5/1998 |
| JP | 10266879 | 10/1998 |
| JP | 10274067 | 10/1998 |
| JP | 10331672 | 12/1998 |
| JP | 11033698 | 2/1999 |
| JP | 11062603 | 3/1999 |
| JP | 11141343 | 5/1999 |
| JP | 2000008870 | 1/2000 |

* cited by examiner

*Primary Examiner*—Edward K. Look
*Assistant Examiner*—Igor Kershteyn
(74) *Attorney, Agent, or Firm*—Woodard, Emhardt, Moriarty, McNett & Henry LLP

(57) ABSTRACT

A turbine in which a turbine wheel is mounted in a housing between an inlet and an outlet. Rotatably mounted vanes are located in the inlet and coupled by linkages to an actuator which is displaceable relative to the vanes so as to control the angular orientation of the vanes relative to the housing inlet. Each vane is coupled to the actuator by a flexible link, the ends of the link being secured to the vanes and actuator in a manner which prevents relative movement between the link ends and the vane or the actuator. Flexing of the links thus accommodates the rotation of the vanes which results from actuator displacements.

22 Claims, 5 Drawing Sheets

TURBINE

FIELD OF THE INVENTION

The present invention relates to a turbine, and in particular to a turbine which can be used in a turbocharger comprising a turbine stage and a compressor stage on a common shaft.

BACKGROUND OF THE INVENTION

In known turbochargers, the turbine stage comprises a turbine wheel, a housing (which may comprise several components) in which the wheel is mounted between an inlet and an outlet defined by the housing, and an array of vanes mounted in the inlet so as to direct gas towards the turbine wheel. It has been known for many years that advantages can be obtained if the turbine stage has a variable flow size, that is a variable inlet cross-section which can be controlled to optimise flow velocities despite variations in mass flow rates.

One widely applied method of varying the flow size of a turbocharger turbine stage is to provide an array of movable vanes in the turbine inlet. Each vane can pivot about an axis extending across the inlet parallel to the turbocharger shaft and aligned with a point approximately half way along the vane length. A vane actuating mechanism is provided which is linked to each of the vanes and is displaceable in a manner which causes each of the vanes to move in unison, such a movement enabling the cross sectional area available for the incoming gas and the angle of approach of the gas to the turbine wheel to be controlled. Such arrangements are generally referred to as swing vane variable geometry turbochargers.

In swing vane turbochargers typically each vane is mounted on a pivot axle, the axle projecting through a wall of the inlet and supporting outside the inlet a crank or lever. The crank of each vane is coupled to an actuator ring which extends around the turbocharger housing generally outside the inlet but adjacent the vane cranks. This actuator ring is generally referred to as a unison ring. The unison ring is coupled either directly to the vane cranks or by links which provide for relative movement between interconnected components. Typically the links are pivotally connected to the vane cranks. Manufacturing considerations mean that there must be clearance at such interconnections and this clearance results in backlash in the mechanism and vibration of the interconnected parts. The temperature of the exhaust gases in which turbocharger turbines operate is such that conventional lubricants are not effective and as a result wear inevitably takes place even if special materials are used. Such wear is detrimental to the performance and controllability of the turbine and hence to the performance of an engine to which the turbocharger is attached. Wear of each individual part in the mechanical chain accumulates such that after the mechanism has been in use for some time backlash in the mechanism can lead to loss of control and possible even total failure.

It is an object of the present invention to obviate or mitigate the problems outlined above.

SUMMARY OF THE INVENTION

According to a first aspect of the present invention, there is provided a turbine comprising a turbine wheel, a housing in which the wheel is mounted between an inlet and an outlet defined by the housing, a plurality of vanes rotatably mounted in the inlet, and an actuator which is displaceable relative to the vanes and is coupled to each vane such that displacement of the actuator causes the vanes to pivot, wherein each vane is coupled to the actuator by a respective flexible link arranged such that actuator displacement causes the links to flex.

The flexibility of the links enables rotation of the vanes as a result of actuator displacement to be accommodated by flexing the links, enabling the use of connections between the links and the vanes which are not subject to backlash.

According to a second aspect of the present invention, there is provided a turbine comprising a turbine wheel, a housing in which the wheel is mounted between an inlet and an outlet defined by the housing, a plurality of vanes rotatably mounted in the inlet, and an actuator which is displaceable relative to the vanes and is coupled to each vane such that displacement of the actuator causes the vanes to pivot, each vane being coupled to the actuator by a respective flexible link arranged such that actuator displacement causes the links to flex, wherein each link has one end secured to the respective vane in a manner which prevents relative movement between the vane and said one end and an other end secured to the actuator in a manner which prevents relative movement between the actuator and said other end.

Similar connections may be used at the ends of the links connected to the actuator. The links may be secured in position by any convenient means which prevents relative movement between the ends of the links and the vane and/or the actuator. For example the links may be secured by rivets or by being received in appropriate slots. As in such arrangements there is no rubbing and hence wear between the various components, long term reliability is enhanced.

Each link preferably flexes in a direction lying in a plane plane perpendicular to the rotational axis of the respective vane.

Each vane may be supported and axially connected to a crank, each vane crank being coupled to a respective link. The actuator may be defined by a ring extending around the housing adjacent to the vanes outside the inlet, the links extending between the actuator ring and the vane cranks.

BRIEF DESCRIPTION OF THE DRAWINGS

Embodiments of the present invention will now be described, by way of example, with reference to the accompanying drawings, in which.

DETAILED DESCRIPTION OF THE PREFERRED EMBODIMENTS

Figure 1:
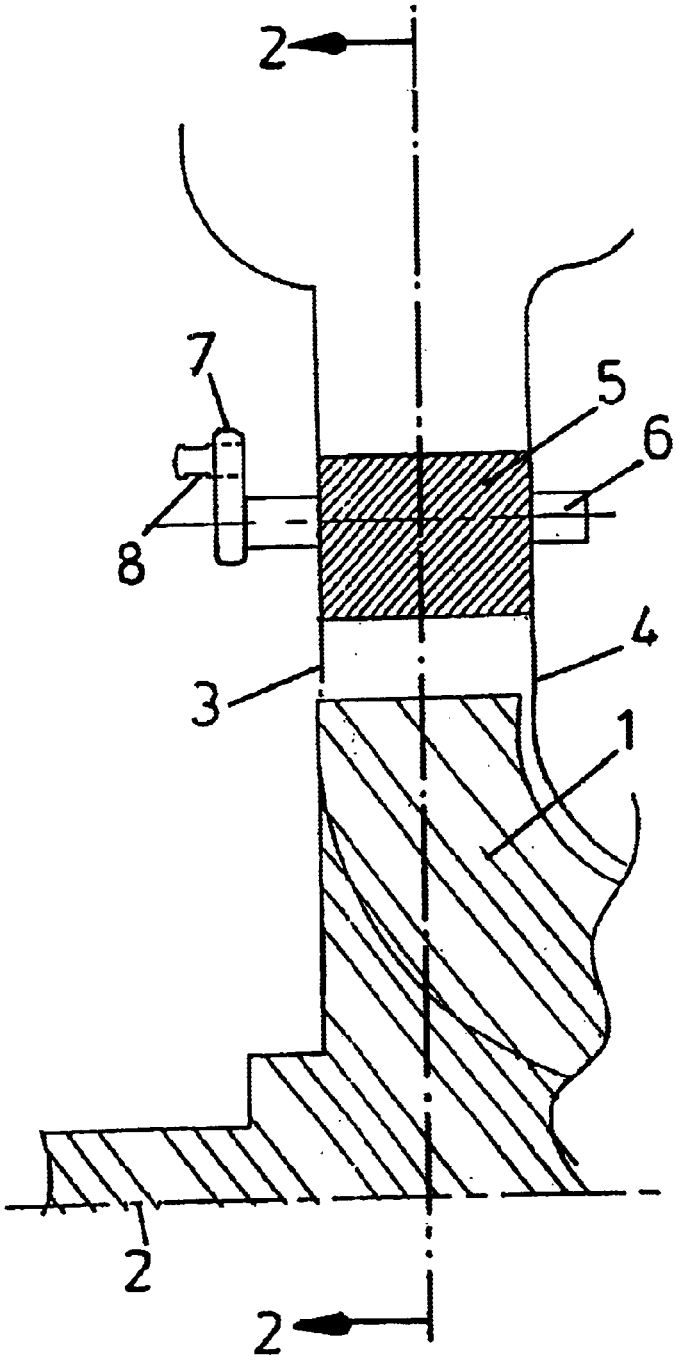
FIG. 1 is a schematic sectional view through a conventional swing vane variable geometry turbine assembly.
Figure 2:
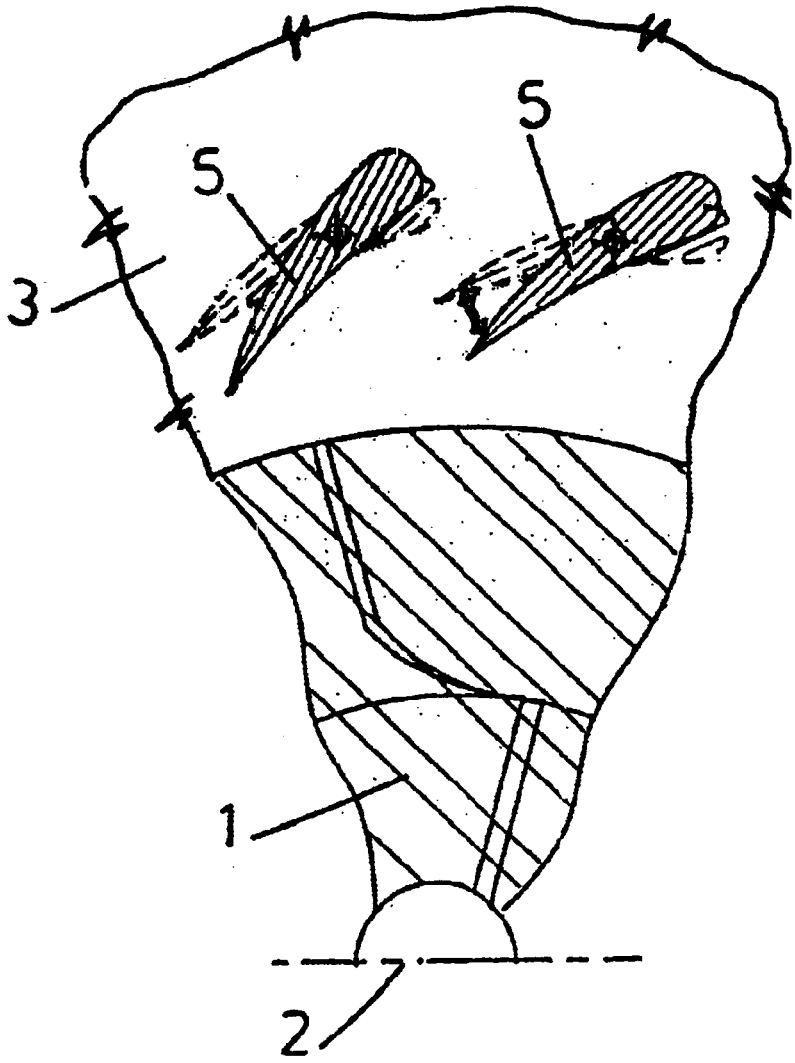
FIG. 2 is a section on the line 2—2 of FIG. 1.

Referring to FIGS. 1 and 2, the schematically illustrated conventional swing vane turbine comprises a turbine wheel 1 rotatable about an axis indicated by a line 2 within a housing having an inlet defined between housing walls 3 and 4. Exhaust gases flow into the inlet in a radially inwards direction to drive the turbine wheel.

Mounted within the inlet is an annular array of vanes 5 each of which is formed with a respective integral axle 6 that projects through the inlet wall and one end of which defines a crank 7. An actuator (not shown) may be coupled to a pin 8 mounted on the crank 7 so as to control rotation of the vane 5 on the axle 6.

FIG. 2 shows two of the adjacent vanes, the vane being shown in full line in one position in which the available cross-section of the inlet is relatively large and in dotted lines in an alternative position in which the available cross-section of the inlet is relatively small. Typically the positions of the vane cranks 7 are controlled by links (not shown) which are pivotally mounted on the pins 8. Given inevitable manufacturing tolerances there will be some clearance between the links and the pins 8. Accordingly, backlash in the vane position control mechanism is inevitable, such backlash increasing with wear.

Figure 3:
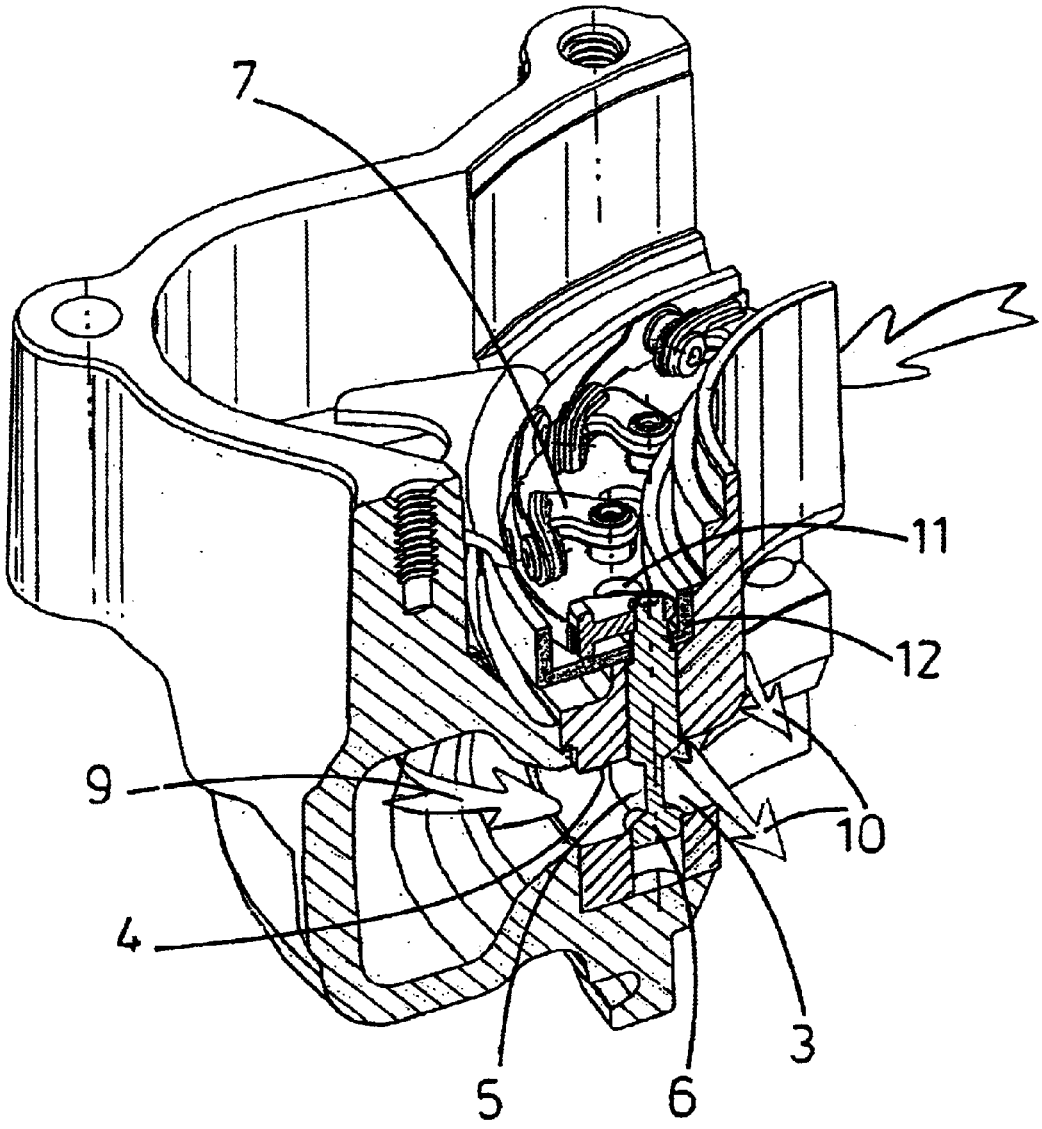
FIG. 3 is a perspective view of quarter of a turbine in accordance with the present invention which has been cut away to expose components of a swing vane assembly.
Figure 4:
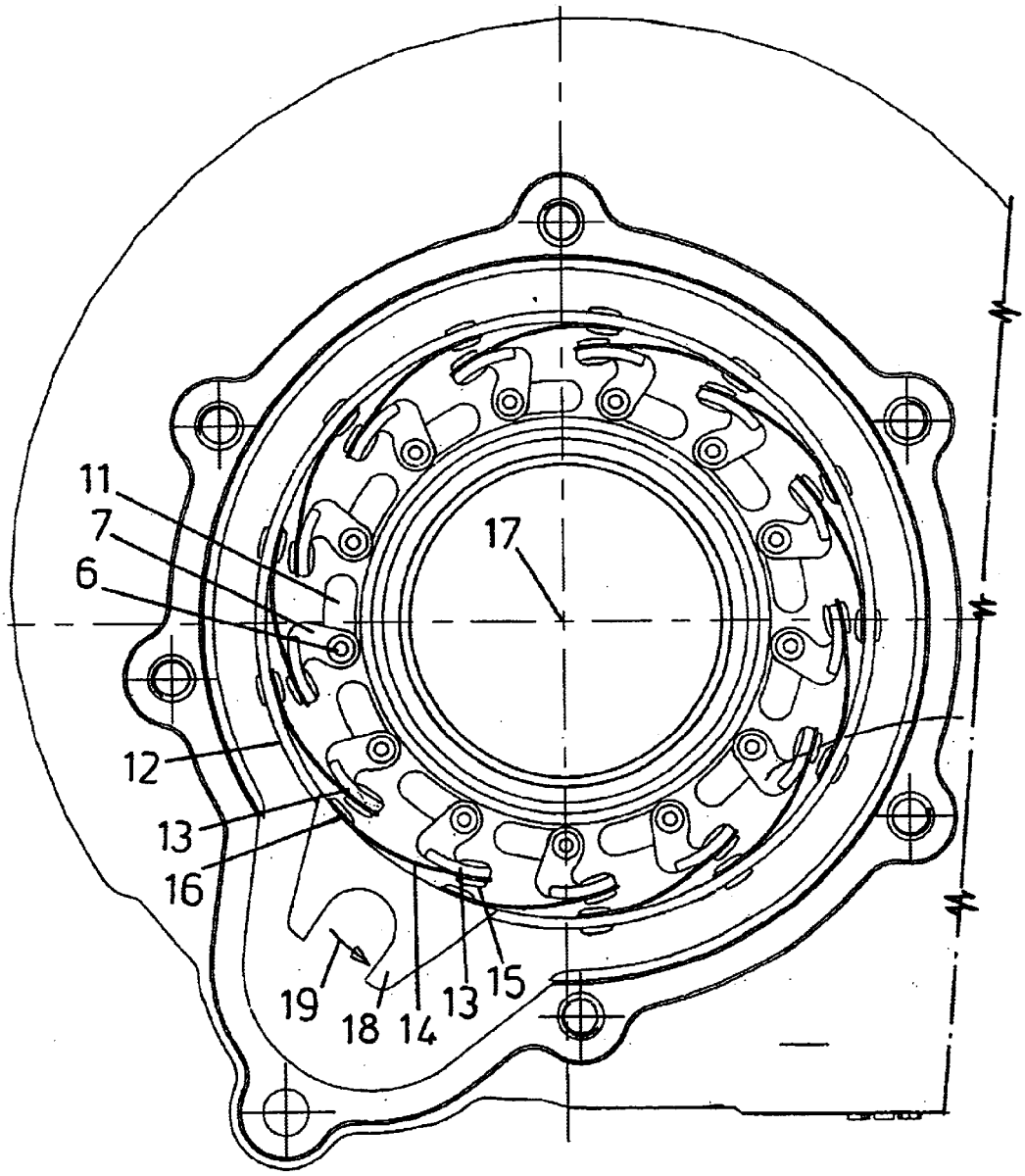
FIG. 4 is an end view in the direction of the turbine axis of the turbine arrangement a part of which is shown in FIG. 3.

Referring now to FIGS. 3 and 4, the illustrated embodiment of the invention avoids backlash and a tendency to wear by linking the vanes to an actuator mechanism using links which are rigidly secured both to the vanes and the actuator mechanism. Where appropriate, the same reference numerals are used in FIGS. 3 and 4 as are used in FIGS. 1 and 2.

Each vane 5 is mounted between surfaces 3 and 4 which define opposite sides of a flow inlet into which exhaust gas is directed as indicated by arrow 9. Gas which flows past the vanes 5 is directed into the turbine wheel housing area as indicated by arrows 10, the gas flow velocity being optimised by appropriate positioning of the vanes 5. Each vane axle 6 extends through the housing wall to project through both the housing wall and a respective slot 11 provided in a unison ring 12. The ends of the axle supports crank 7. As is best seen in FIG. 3, the unison ring in this embodiment is of u-shaped cross-section.

Each crank 7 supports a circumferentially-extending arm 13 to which a flexible link 14 of spring material is secured by a rivet 15. The other end of the flexible link is secured to the unison ring by a further rivet 16. The unison ring is rotatable about an axis 17 which corresponds with the rotation axis of the turbine wheel (not shown).

The angular position of the unison ring 12 about the axis 17 is controlled by movement of an input bracket 18 in the direction indicated by an arrow 19. Displacement of the unison ring 12 is accommodated by the slots 11 in the ring. Given the flexible nature of the links 14, as the unison ring is moved in the direction of arrow 19 each of the axles 6 is rotated in the anticlockwise direction of FIG. 4. Rotation about the axle 6 is accommodated by flexing of the links 14. No relative movement occurs between either end of the links 14 and the components which the ends of those links are secured by rivets 15 and 16. Thus the system is not subject to backlash nor wear as a result of relative movement between interconnected components.

In the embodiment of the invention illustrated in FIGS. 3 and 4, the links 14 are secured in position by rivets 15 and 16. Other methods of attachment of the links to the unison ring and vane cranks 7 are however possible. For example, it may be possible to secure the spring material of the links 14 in position by engaging ends of the links in slots provided in the unison ring, or in the vane cranks.

Figure 5:
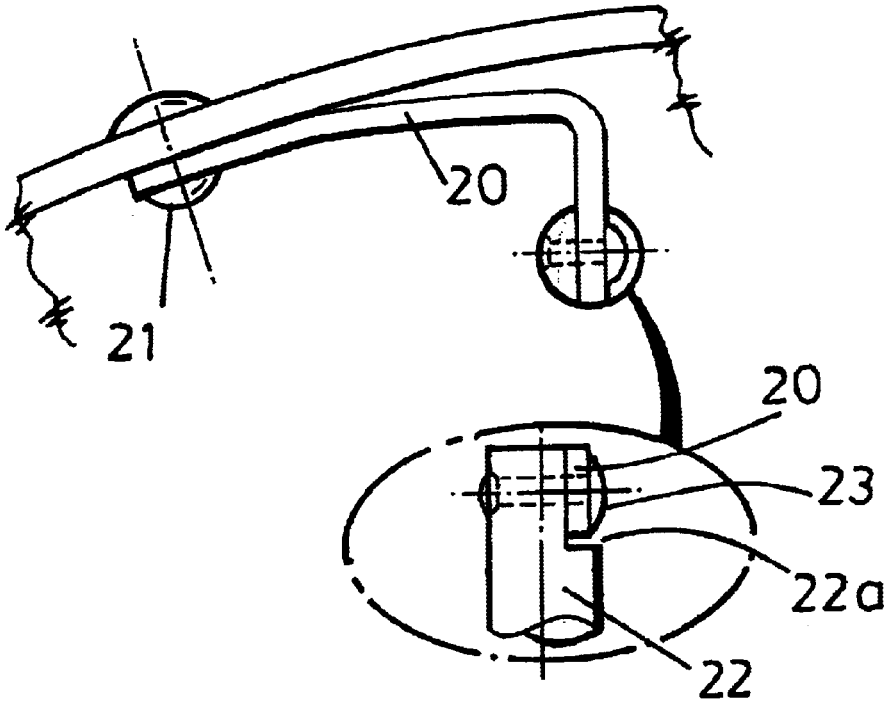
FIG. 5 illustrates one alternative swing vane linkage in accordance with the present invention.

In other embodiments of the invention the flexible links may be designed for direct connection between the unison ring and the respective vane axle. An example of such an embodiment is illustrated in FIG. 5. It will be seen that here the link 20 is formed in a generally "L" shape, the long portion of the link 20 being riveted to the unison ring by a rivet 21 and the short portion of the link 20 being riveted directly to a modified vane axle 22 by a rivet 23 (a cut-out 22*a* is formed in the end of the vane axle to accommodate the rivet connection). The detailed design of the L shaped link 20 could be controlled to ensure flexing is confirmed to a particular region of the link, for instance the long portion riveted to the unison ring, to minimise fatigue.

In order to control the position of the unison ring, a peg could be inserted in the u-shape slot in the bracket 18, displacement of the peg causing displacement of the unison ring. Such an arrangement would itself be prone to some backlash and it might be advantageous to link the peg or other input device to the unison ring by a flexible link similar to the flexible links used to interconnect the unison ring and vanes.

Having thus described the invention, what is claimed as novel and desired to be secured by Letters Patent of the United States is:

1. A radial inflow turbine comprising a turbine wheel, a housing in which the wheel is mounted between an inlet and an outlet defined by the housing, a plurality of vanes rotatably mounted in the inlet, an actuator which is displaceable relative to the vanes and is coupled to each vane such that displacement of the actuator causes the vanes to pivot, wherein each vane is coupled to the actuator by a respective flexible link, each flexible link coupling a single vane to the actuator and being arranged such that said actuator displacement causes the links to flex to pivot the vanes, wherein each link has a first end and a second end, said first end secured to the respective vane to prevent relative movement between the respective vane and said first end and said second end is secured to said actuator to prevent relative movement between said actuator and said second end.

2. A turbine according to claim 1, wherein each of said links extending substantially circumferentially relative to said actuator, and further wherein the turbine is a turbocharger turbine.

3. A turbine according to claim 1, wherein each end of said link is substantially axially aligned with said actuator, and wherein said radial inflow turbine is a turbocharger turbine.

4. A turbine according to claim 1, wherein the link ends are secured by rivets.

5. A turbine according to claim 1, wherein the link ends are inserted into and secured within slots.

6. A turbine according to any preceding claim, wherein each vane is supported on an axle connected to a crank, each vane crank being coupled to a respective link.

7. A turbine according to claim 6, wherein the actuator is defined by a ring extending around the housing adjacent to the vanes outside the inlet, the links extending between the actuator ring and the vane cranks.

8. A turbine according to claim 5, wherein each vane is supported on an axle and each link is directly coupled to a respective vane axle.

9. A turbine according to claim 8, wherein each link is generally L shaped.

10. A turbine according to claim 9, wherein each flexible link rotates in a direction lying in a plane substantially perpendicular to the pivot axis of the respective vane.

11. A turbocharger turbine comprising a turbine wheel, a housing in which the wheel is mounted between an inlet and an outlet defined by the housing, a plurality of vanes rotatably mounted in the inlet, an actuator which is displaceable relative to the vanes and is coupled to each vane such that displacement of the actuator causes the vanes to pivot, each vane being coupled to the actuator by a respective flexible link arranged such that said actuator displacement causes the links to flex to pivot the vanes, wherein each link has one end secured to the respective vane in a manner which prevents relative movement between the vane and said one end and an other end secured to the actuator in a manner which prevents relative movement between the actuator and said other end.

12. A turbine comprising a turbine wheel, a housing in which the wheel is mounted between an inlet and an outlet defined by the housing, a plurality of vanes rotatably mounted in the inlet, an actuator which is displaceable relative to the vanes and is coupled to each vane such that displacement of the actuator causes the vanes to pivot, wherein said actuator is pivotal about an axis substantially parallel to the axis of rotation of said turbine, wherein each vane is coupled to the actuator by a respective flexible link, each flexible link coupling a single vane to the actuator and being arranged such that actuator displacement causes the links to flex.

13. A turbine according to claim 12, wherein each link has an end secured to the respective vane in manner which prevents relative movement between the vane and the end secured to the vane.

14. A turbine according to claim 13, wherein each link has an end secured to the actuator in a manner which prevents relative movement between the actuator and the link end secured to the actuator.

15. A turbine according to claim 14, wherein the link ends are secured by rivets.

16. A turbine according to claim 14, wherein the link ends are inserted into and secured within slots.

17. A turbine according to claim 16, wherein each vane is supported on an axle and each link is directly coupled to a respective vane axle.

18. A turbine according to claim 17, wherein each link is generally L shaped.

19. A turbine according to claim 18, wherein each flexible link rotates in a direction lying in a plane substantially perpendicular to the pivot axis of the respective vane.

20. A turbine according to any preceding claim, wherein each vane is supported on an axle connected to a crank, each vane crank being coupled to a respective link.

21. A turbine according to claim 20, wherein the actuator is defined by a ring extending around the housing adjacent to the vanes outside the inlet, the links extending between the actuator ring and the vane cranks.

22. A turbocharger turbine comprising a turbine wheel, a housing in which the wheel is mounted between an inlet and an outlet defined by the housing, a plurality of vanes rotatably mounted in the inlet, an actuator which is displaceable relative to the vanes and is coupled to each vane such that displacement of the actuator causes the vanes to pivot, wherein said actuator is pivotal about an axis substantially parallel to the axis of rotation of said turbine, each vane being coupled to the actuator by a respective flexible link arranged such that said actuator displacement causes the links to flex to pivot the vanes, wherein each link has one end secured to the respective vane in a manner which prevents relative movement between the vane and said one end and an other end secured to the actuator in a manner which prevents relative movement between the actuator and said other end, and further wherein each of said links extending substantially circumferentialy relative to said actuator and axially aligned with said actuator.

* * * * *

UNITED STATES PATENT AND TRADEMARK OFFICE

CERTIFICATE OF CORRECTION

PATENT NO. : 6,779,971 B2
DATED : August 24, 2004
INVENTOR(S) : Stephen E. Garrett It is certified that error appears in the above-identified patent and that said Letters Patent is hereby corrected as shown below:

Column 5,
Line 33, please renumber claim 17 to claim 19.

Column 6,
Line 1, please renumber claim 18 to claim 20.
Line 1, please change the dependency from "claim 17" to -- claim 19 --.
Line 3, please renumber claim 19 to claim 21.
Line 3, please change the dependency from "claim 18" to -- claim 20. --.
Line 6, please renumber claim 20 to claim 17.
Line 10, please renumber claim 21 to claim 18.
Line 10, please change the dependency from "claim 20" to -- claim 17. --.

Signed and Sealed this

Twenty-third Day of November, 2004

JON W. DUDAS
*Director of the United States Patent and Trademark Office*